US007214881B2

(12) United States Patent
Nelson et al.

(10) Patent No.: US 7,214,881 B2
(45) Date of Patent: May 8, 2007

(54) HIGH TEMPERATURE ELECTRICAL CONNECTION

(75) Inventors: Charles Scott Nelson, Fenton, MI (US); Robert G. Minard, Bridgeport, MI (US); Paul Hugo Ruterbusch, Flushing, MI (US); Kathryn Mary McCauley, Durand, MI (US); Kaius Kiiren Polikarpus, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/925,890

(22) Filed: Aug. 25, 2004

(65) Prior Publication Data

US 2005/0217889 A1 Oct. 6, 2005

Related U.S. Application Data

(60) Provisional application No. 60/558,793, filed on Apr. 1, 2004.

(51) Int. Cl.
*H01R 4/18* (2006.01)

(52) U.S. Cl. ..... 174/94 R

(58) Field of Classification Search ..... 174/117 F, 174/117 FF, 84 C, 88 R, 94 R; 439/876
See application file for complete search history.

(56) References Cited

U.S. PATENT DOCUMENTS 3,615,734 A * 10/1971 Cole ..... 106/1.13
RE27,743 E * 8/1973 Weimer, Jr. ..... 174/94 R
4,362,903 A * 12/1982 Eichelberger et al. .... 174/94 R
4,661,887 A * 4/1987 Lin ..... 361/773
4,697,885 A * 10/1987 Minowa et al. ..... 349/149
4,794,048 A * 12/1988 Oboodi et al. ..... 428/432
4,819,115 A * 4/1989 Mitchell ..... 361/308.3
4,991,059 A * 2/1991 Kiyose ..... 361/773
5,097,100 A * 3/1992 Jackson ..... 174/94 R
5,270,492 A * 12/1993 Fukui ..... 174/52.4
5,610,572 A * 3/1997 Yajima ..... 338/22 R
6,822,331 B2 * 11/2004 Eytcheson ..... 257/773
2004/0251230 A1 * 12/2004 Wardzala et al. ..... 216/13

* cited by examiner

*Primary Examiner*—Chau N. Nguyen
(74) *Attorney, Agent, or Firm*—Paul L. Marshall

(57) ABSTRACT

An electrical connection is made by connecting a metal element to a second element to which the electrical connection is desired to be made by means of a conductive material disposed onto one or both of the metal element and the second element so as to contact and disperse about or through the metal element thereby providing both an electrical and a mechanical connection. The metal element may be a strip or pad with openings or knurls formed such as by stamping, a wire that is flattened and knurled, or a mesh material such as a wire mesh. In a preferred embodiment, the conductive material is a metal capable of withstanding harsh, high temperature environments, such as a noble metal. In another preferred embodiment, the second element is a ceramic element, preferably with a noble metal conductive pad thereon, to which the metal element is attached.

23 Claims, 4 Drawing Sheets

HIGH TEMPERATURE ELECTRICAL CONNECTION

CROSS-REFERENCE TO RELATED APPLICATIONS

The present application claims priority to U.S. Provisional Application No. 60/558,793, of Charles Scott Nelson, et al., filed Apr. 1, 2004, entitled "High Temperature Electrical Connection," which is hereby incorporated by reference herein in its entirety.

TECHNICAL FIELD

The present invention relates to an electrical connection and more particularly relates to an electrical connection and a method for preparing an electrical connection suitable for use in harsh, high temperature environments such as the exhaust stream of an internal combustion engine.

BACKGROUND OF THE INVENTION

In high temperature environments, it is often necessary to provide electrical connections in or to equipment or instrumentation that must operate in the environment. For example, sensors are often used to monitor the properties of exhaust gas of internal combustion engines where the exhaust temperature can reach 1000° C. Such sensors generally require electrical connections as an integral part of the sensor and/or to connect the sensor to a lead wire for transmission of the sensor output signal. Electrical connection requirements of such sensors can be complicated by the fact that it is often necessary to make the electrical connection to a ceramic element of the sensor.

Mechanical connections are often not sufficiently robust to maintain their performance in the harsh conditions of the high-temperature environment, so wire bonding of a wire to a sensor element is typically employed to provide the electrical connection. Alternatively, brazing techniques may be used to provide the electrical connection. Both of these methods can be expensive and time-consuming to implement.

U.S. Pat. No. 5,730,543 to Schonauer et al. entitled "Electrically Conducting Connection" describes an electrically conductive connection made between a metal connector and a metal layer applied and bonded by sintering to a ceramic substrate comprising glass and/or vitreous ceramic in small quantities. An adhesion-promoting layer having a glass and/or vitreous ceramic and metal particles is applied and bonded by fusion to the ceramic substrate. The metal layer with the sintered bond is then applied to the ceramic substrate and the connector is welded to the metal layer by laser welding.

U.S. Pat. No. 6,437,681 to Wang et al. entitled "Structure and Fabrication Process for an Improved High Temperature Sensor" describes a temperature sensor including an aluminum oxide substrate and a thin-film resistor having a specific temperature coefficient of resistance (TCR) disposed over the substrate. The temperature sensor further includes an aluminum oxide stress-relief layer covering the thin film resistor. The temperature sensor further includes a passivation layer covering the aluminum oxide stress-relief layer. The aluminum oxide stress-relief layer further has at least one resistor-trimming trench formed by removing a portion of the aluminum oxide stress-relief layer and thin-film resistor therefrom and the resistor-trimming trench is filled with a material of the passivation layer. The temperature sensor may further include a set of dummy pads for resistance-trimming measurement disconnected from the thin film resistor disposed on the substrate near the thin film resistor covered by the passivation layer. The temperature sensor may further include a set of sensor bonding pads disposed on the substrate electrically connected to the thin film resistor covered by the passivation layer. The temperature sensor further includes a set of platinum chip-leads bonded to the sensor bonding pads for temperature measurement connections.

The disclosures of the foregoing are incorporated herein by reference in their entireties.

A need remains in the art for a simple, inexpensive, and effective way of establishing electrical connections in harsh environmental conditions.

SUMMARY OF THE INVENTION

The present invention provides an electrical connection comprising a metal element; and a second element to which an electrical connection is to be made; wherein the metal element is connected to the second element by means of a conductive material disposed onto one or both of the metal element and the second element; and wherein the metal element has a configuration such that the conductive material contacts and is dispersed about or about and through at least a portion of the metal element thereby providing both an electrical and a mechanical connection between the metal element and the second element.

The invention further provides a method for preparing an electrical connection comprising providing a metal element and a second element to which an electrical connection is to be made; disposing a conductive material onto one or both of the metal element and the second element; contacting the metal element and the second element wherein the metal element has a configuration such that the conductive material contacts and disperses about or about and through at least a portion of the metal element thereby providing both an electrical and a mechanical connection between the metal element and the second element; drying the connected metal element and second element; and firing the connected metal element and second element.

These and other features and advantages of the invention will be more fully understood from the following description of certain specific embodiments of the invention taken together with the accompanying drawings.

BRIEF DESCRIPTION OF THE DRAWINGS

Referring now to the drawings, which are meant to be exemplary, not limiting, and wherein like elements are numbered alike in the several Figures.

DESCRIPTION OF THE PREFERRED EMBODIMENT

Figure 1:
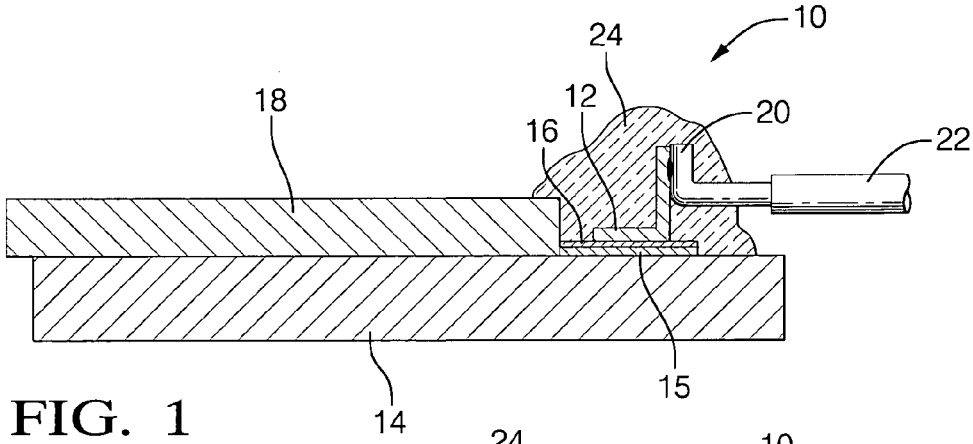
FIG. 1 is a side cross-sectional view of an electrical connection in accordance with the invention including a metal element comprising a metal strip having openings or knurls disposed thereon.

Referring now to FIG. 1, one possible embodiment of the present electrical connection 10 and method for preparing the electrical connection 10 is illustrated. The electrical connection 10 includes a metal element 12 connected to a second element 14 via a conductive material 16 disposed onto one or both of the metal element 12 and the second element 14 such that the conductive material 16 contacts and disperses about or about and through the metal element 12 thereby providing both an electrical and a mechanical connection between the metal element 12 and the second element 14. A cover plate 18 is disposed over the second element 14. A protective glass seal 24 is disposed over the electrical connection area. A resistance or laser weld 20 or other suitable weld means is used to connect the electrical connection 10 to a wire or cable 22.

The metal element 12 of FIG. 1 may be a metal strip or pad having a plurality of openings disposed thereon such as by stamping, although any suitable means may be employed to dispose the openings onto the metal strip or pad. The invention contemplates any number of stamping patterns, such as, but not limited to, a pattern forming a "Swiss cheese-like" effect. Alternatively, the metal strip or pad 12 of FIG. 1 may be configured with a plurality of knurls, knots, protuberances, nodules, bosses, or other type of projection collectively referred to herein as "knurls." The knurls may be formed on the metal strip by any suitable means such as stamping or knurling.

The metal element 12 preferably comprises a metal that is capable of withstanding a harsh, high temperature environment, such as a noble metal including, but not limited to, platinum. Alternately, the metal element 12 comprises a material coated with a metal, preferably a noble metal, most preferably platinum, that is capable of withstanding a high temperature environment.

In a preferred embodiment, the second element 14 is a ceramic element, preferably with a conductive pad, most preferably a noble metal conductive pad (for example, platinum), 15 disposed thereon, to which the metal element 12 is attached.

Figure 2:
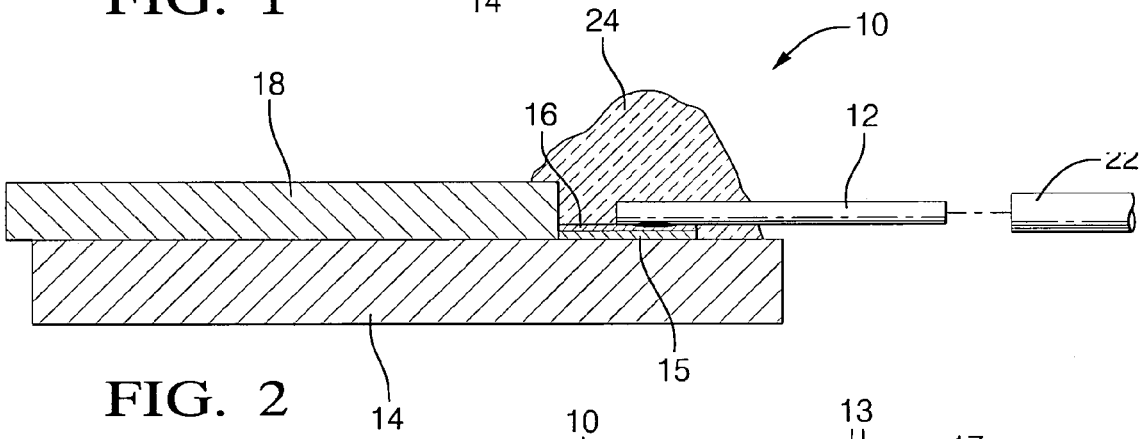
FIG. 2 is a side cross-sectional view of an electrical connection in accordance with another embodiment of the invention including a metal element comprising a flattened, knurled wire.

In yet another embodiment, as shown in FIG. 2, the metal element 12 comprises a round wire that is flattened and patterned with a plurality of knurls. The flattening and knurling may be accomplished in one step or in two separate steps. The metal element 12 of FIG. 2 may alternately represent a wire mesh. As in the connection of FIG. 1, the flattened, knurled wire or wire mesh 12 is welded to the cable 22.

FIGS. 3–11 illustrate a variety of electrical connections 10 in accordance with alternate embodiments of the invention.

Figure 3:
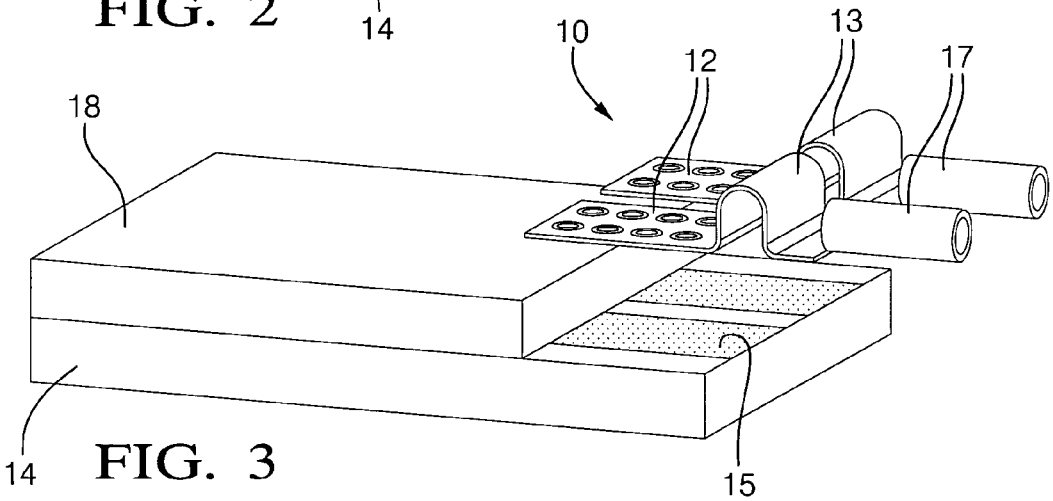
FIG. 3 is a perspective view of an electrical connection in accordance with yet another embodiment of the invention.
Figure 4:
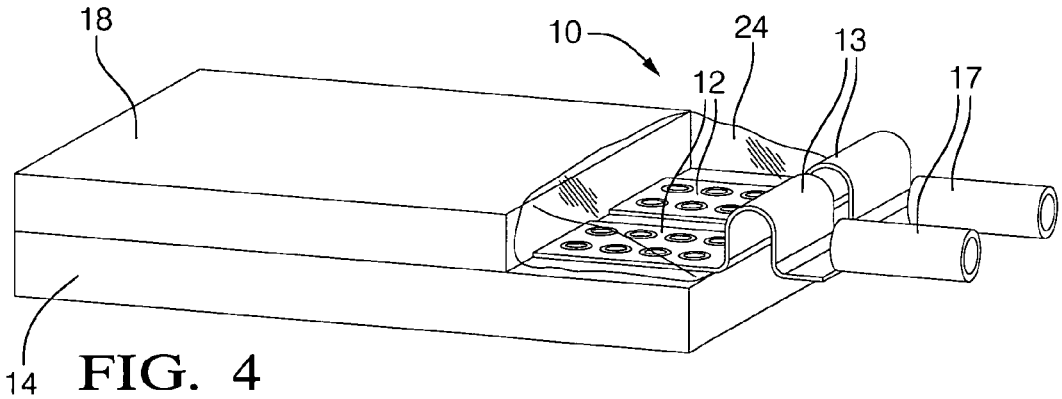
FIG. 4 is a perspective view of the electrical connection of FIG. 3 having a glass seal disposed thereon.

FIG. 3 is a perspective view of an electrical connection 10 in accordance with another embodiment of the invention wherein the metal element 12 includes a crimp portion 17 and a strain relief 13 providing minimization of deleterious effects from thermal expansion mismatches between materials. FIG. 4 shows in perspective view the electrical connection of FIG. 3 after drying, firing, and disposing a glass potting seal 24 thereon.

Figure 5:
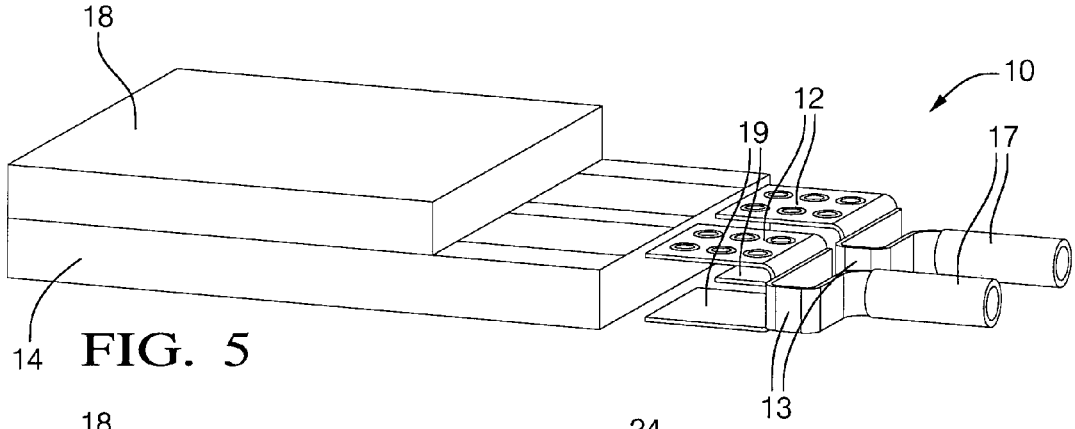
FIG. 5 is a perspective view of a clipped electrical connection in accordance with another embodiment of the invention.
Figure 6:
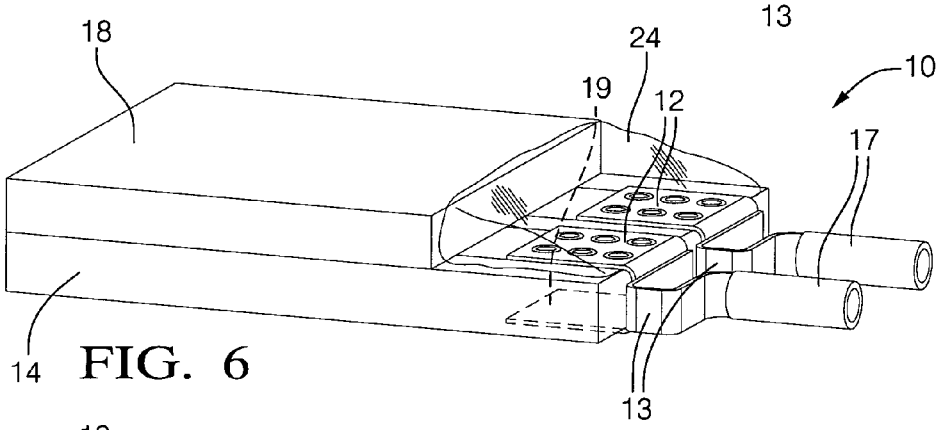
FIG. 6 is a perspective view of the clipped electrical connection of FIG. 5 having a glass seal disposed thereon.

FIG. 5 is perspective view of an electrical connection 10 in accordance with another embodiment of the invention wherein the metal element 12 includes a crimp portion 17, a strain relief portion 13, and a clip portion 19 for securing the electrical connection 10 until the conductive material 16 is dried. Thereafter, the clip configuration of this embodiment provides increased mechanical strength to the overall electrical connection 10. FIG. 6 is a perspective view of the electrical connection 10 of FIG. 5 after drying, firing, and disposing a glass potting seal 24 thereon.

Figure 7:
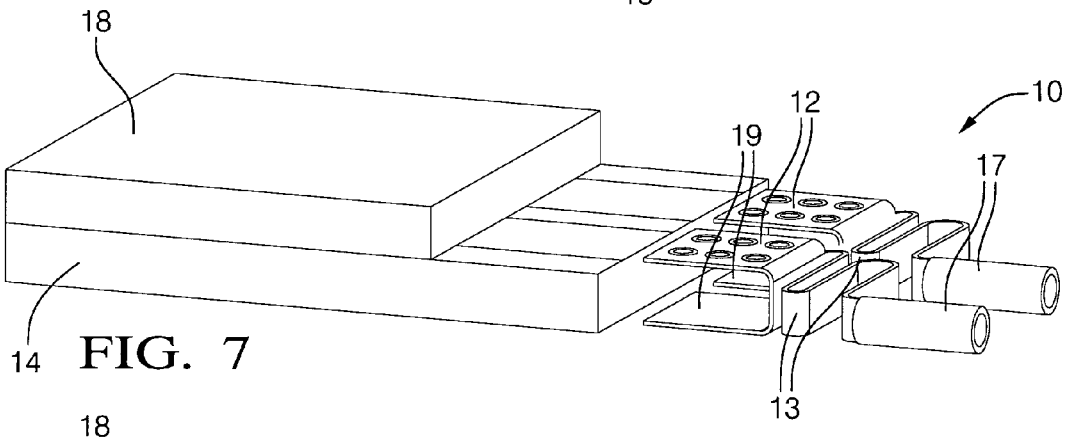
FIG. 7 is a perspective view of a clipped electrical connection in accordance with another embodiment of the invention.
Figure 8:
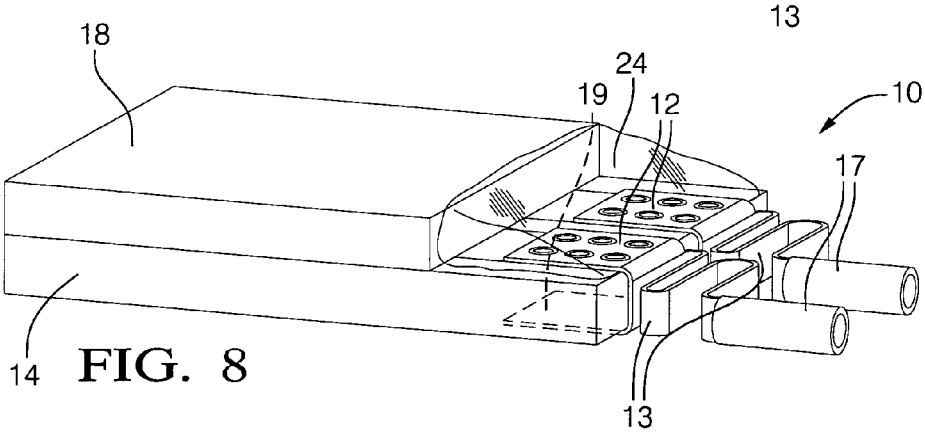
FIG. 8 is a perspective view of the clipped electrical connection of FIG. 7 having a glass seal disposed thereon.

FIG. 7 is a perspective view of an electrical connection 10 in accordance with yet another embodiment of the invention wherein the metal element 12 includes a crimp portion 17, a strain relief portion 13, and a clip portion 19 for securing the electrical connection 10 until the conductive material 16 is dried. FIG. 8 is a perspective view of the electrical connection of FIG. 7 after drying, firing, and disposing a glass potting seal 24 thereon.

Figure 9:
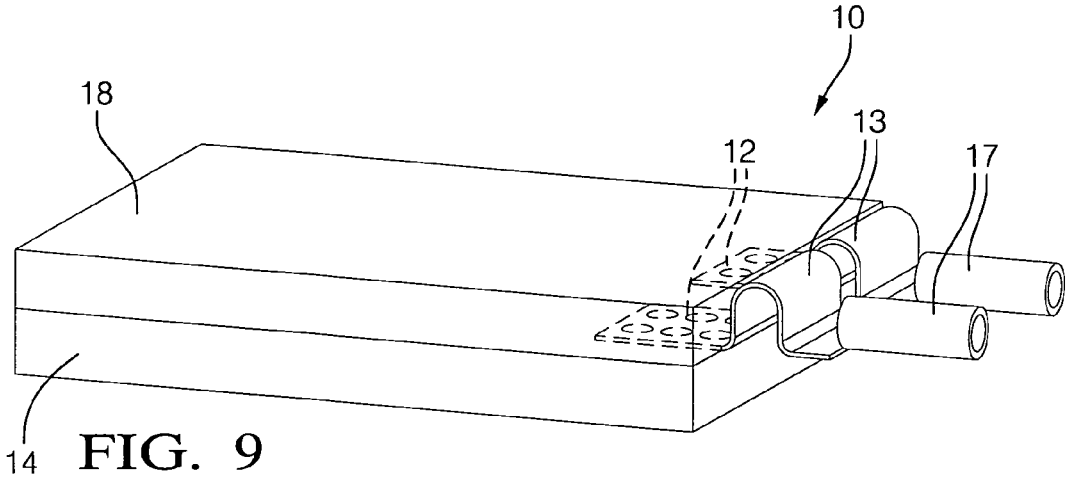
FIG. 9 is a perspective view of a sandwiched electrical connection in accordance with another embodiment of the invention.

FIG. 9 is a perspective view of a sandwiched electrical connection 10 in accordance with another embodiment of the invention. In this embodiment, the metal element 12 is sandwiched between the cover plate 18 and second element 14 eliminating the need for a glass potting seal. The connection is protected by the cover plate 18 and element 14.

Figure 10:
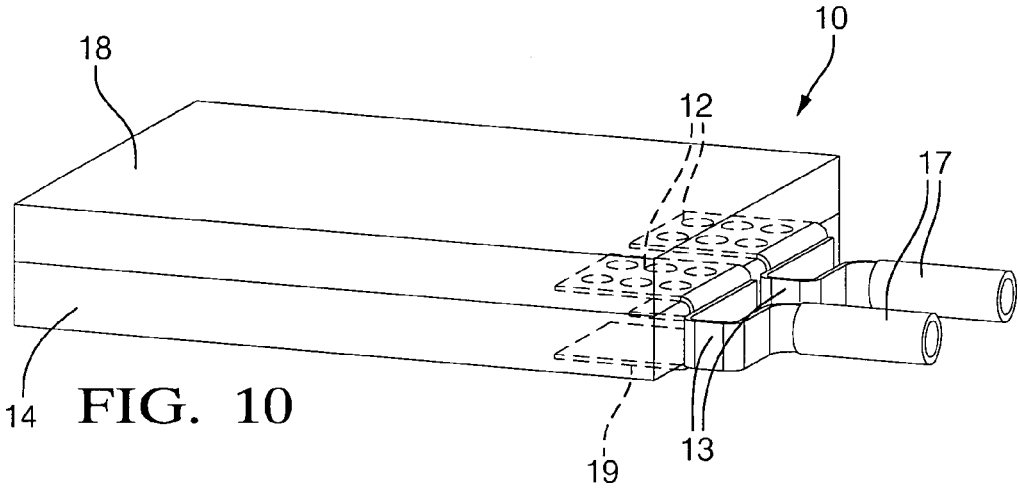
FIG. 10 is a perspective view of a sandwiched electrical connection in accordance with another embodiment of the invention.

FIG. 10 is a perspective view of a sandwiched electrical connection 10 in accordance with another embodiment of the invention. As in FIG. 9, the metal element 12 is sandwiched between the cover plate 18 and the second element 14 eliminating the need for a glass potting seal.

Figure 11:
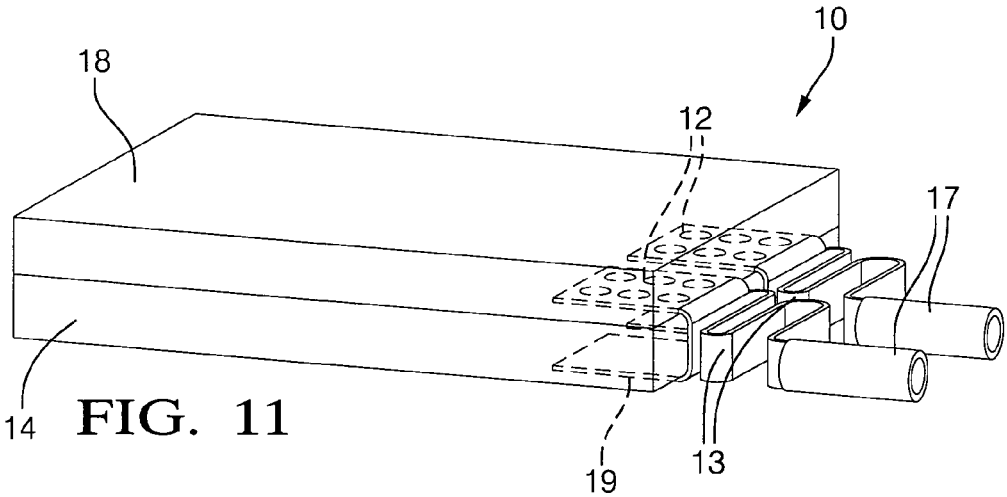
FIG. 11 is a perspective view of a sandwiched electrical connection in accordance with another embodiment of the invention.
Figure 12:
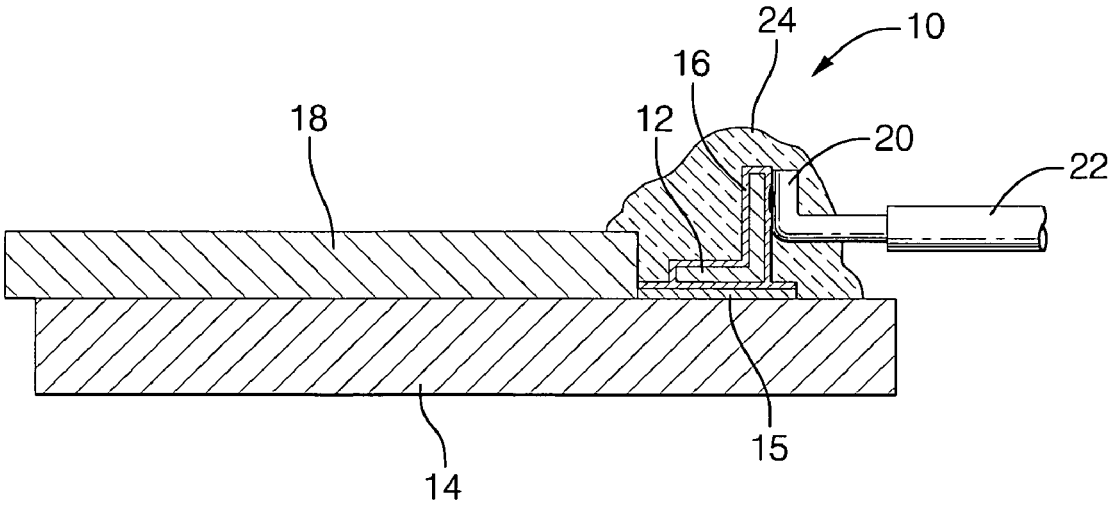
FIG. 12 is a side cross-sectional view of the electrical connection of FIG. 1, but with the metal element completely covered by conductive material.
Figure 13:
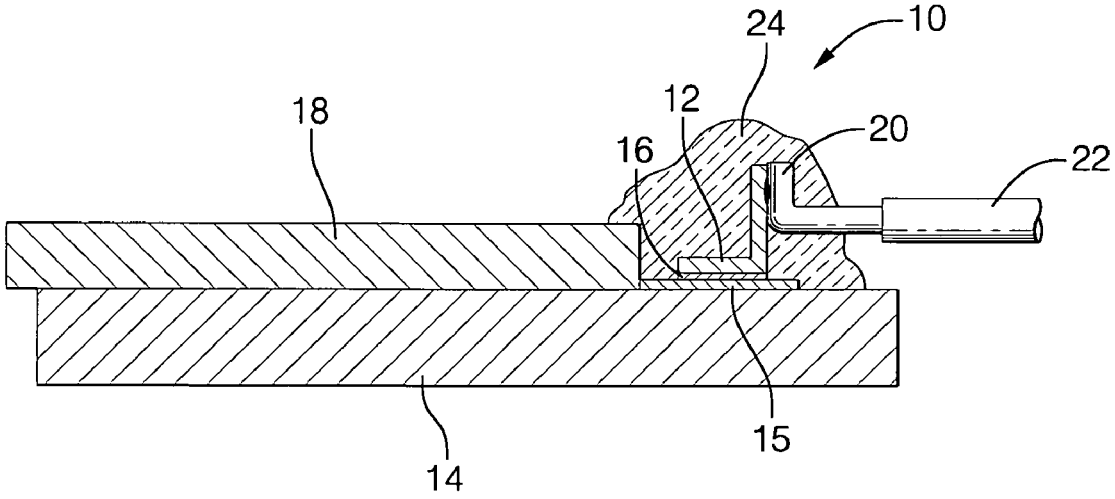
FIG. 13 is a side cross-sectional view of the electrical connection of FIG. 1, but with only the surface area of the metal element connected to the second element covered by conductive material.

FIG. 11 is a perspective view of a sandwiched electrical connection 10 in accordance with yet another embodiment of the invention. Again, the metal element 12 is sandwiched between the cover plate 18 and the second element 14 eliminating the need for a glass potting seal.

In a particularly advantageous feature of the present electrical connection, the metal element 12 configured with a plurality of openings or knurls provides increased surface area for the conductive material 16 to contact thereby forming in combination an electrical and a mechanical connection.

After the conductive material 16 onto one or both of the metal element 12 and second element 14, the metal element 12 and the second element 14 are brought into contact so that the conductive material 16 seeps through the holes or mesh of the metal element 12 or around and about the knurls of the metal element 12. The thus formed electrical and mechanical connection 10 is then dried in an oven, typically at a temperature of about 120° C., and fired in an oven, typically at a temperature of about 1300° C., although drying and firing temperatures are selected in accordance with the particular materials.

Preferably, the connection 10 is covered with a high temperature-resistant protective seal such as a glass seal 24 that is disposed upon the electrical and mechanical connection. For example, the connection 10 may be covered with a protective seal such as glass potting 24 providing additional mechanical strength and preventing corrosion from attacking the conductive material 16. In the embodiments comprising sandwiched connections, such as illustrated in FIGS. 9–11, the need for a glass 24 potting is eliminated.

The invention contemplates an electrical connection 10 generally, and is particularly suitable for use in harsh, high temperature environments such as internal combustion engine exhaust streams, for example. The second element 14, to which the metal element 12 is attached may be, for example, but is not limited to, a gas sensor such as a NOx sensor, etc., a temperature sensor, a plasma reactor connection, among others.

The conductive material 16 may be disposed so as to completely cover the metal element 12. Alternately, the conductive material 16 may be disposed so as to cover the metal element 12 only in the area where the electrical and mechanical connection to the second element 14 is to be made. For example, in one embodiment, the metal strip 12 is plated (e.g., coated) with a precious metal at the top and bottom portions of the metal strip 12 only where the holes or projections are disposed. In another embodiment, the entire metal strip 12 is plated with a precious metal.

The conductive material 16 may be any suitable conductive material as known in the art, including, but not limited to, conductive ink pastes generally containing a metal such as a noble metal in a binder-adhesion system such as a spinel, glass frit, or alumina frit. The precious metal may be any metal and is preferably a metal that can withstand high temperature environments. Preferably, the precious metal is the same type of metal that occupies the pad or portion of the ceramic to which the electrical connection is being attached.

In a preferred embodiment, an excess amount of ink paste (i.e., conductive material 16) is disposed such as onto the ceramic pad 15. The horizontal portion of the metal strip 12 is set down onto the excess ink. The ink will seep into the openings and/or around the knurls and overfill the top by some amount, depending on how much ink is used. The metal strip 12 is held in place by capillary action.

The electrical connection assembly is then dried and fired. After firing, the metal strip 12 is bonded to the sensor output wire 22 such as by any type of metal weld, including, but not limited to, a diffusion weld, a resistance weld, or a laser weld. The protective glass seal 24 is typically coated over the bonded area.

The invention claimed is:

1. A high temperature environment electrical connection comprising:

a metal element formed or coated of a noble metal defining opposed surfaces interconnected by a plurality of openings; and a second element including a ceramic substrate and a pad to which an electrical connection is to be made, said pad comprising a noble metal and affixed to a surface of said ceramic substrate; and a third element that is a ceramic substrate connected by said conductive material to a surface of said metal element opposite of the metal element surface connected to said second element;

wherein the metal element is interconnected to the pad by means of a fired conductive material disposed intermediate one of the surfaces of the metal element and the pad, said conductive material comprising a noble metal and a spinel, glass frit, or alumina frit; and wherein the metal element has a configuration such that the conductive material is also dispersed about or within at least a portion of the openings formed by the metal element thereby providing both an electrical and a mechanical connection between the metal element and the second element which is resistant to high temperature environments.

2. The electrical connection of claim 1, wherein the metal element comprises a strip having an array of openings disposed thereon, each said opening forming a passageway between said opposed surfaces.

3. The electrical connection of claim 1, wherein the metal element comprises a strip having a plurality of knurls disposed thereon.

4. The electrical connection of claim 1, wherein the metal element comprises a strip having a mesh-like configuration.

5. The electrical connection of claim 1, wherein the metal element comprises a flattened, knurled wire.

6. The electrical connection of claim 1, wherein the metal element comprises platinum or a material coated with platinum.

7. The electrical connection of claim 1, wherein the conductive material is disposed so as to completely cover the metal element.

8. The electrical connection of claim 1, wherein the conductive material is disposed so as to cover the metal element only in the areas where the electrical and mechanical connection to the second element is to be made.

9. The electrical connection of claim 1, wherein the conductive material is a noble metal and wherein the noble metal is disposed so as to completely cover the metal element.

10. The electrical connection of claim 1, further comprising:

a high temperature-resistant protective glass seal disposed upon the electrical and mechanical connection.

11. The electrical connection of claim 1 wherein the noble metal of the metal element is of the same composition as the noble metal of the pad, which is of the same composition as the noble metal of the conductive material are each the same noble metal.

12. A method for preparing a high temperature environment electrical connection comprising:

providing a metal element and a second element, said metal element formed or coated of a noble metal defining first and second opposed surfaces interconnected by a plurality of openings, and said second element including a ceramic substrate and a pad comprising a noble metal affixed to a surface of said ceramic substrate to which an electrical connection is to be made;

disposing an unfired conductive material comprising a noble metal and a spinel, glass frit, or alumina frit onto one or both of the metal clement and the pad;

contacting the first surface of the metal element and the pad of second element wherein the metal element has a configuration and the unfired curable material has sufficient fluidity such that the conductive material contacts and disperses intermediate one of the surfaces of the metal element and the pad and through the openings of at least a portion of the metal element thereby providing both an electrical and a mechanical connection between the metal element and the second element;

contacting the second surface of the metal element with a third element comprising a ceramic substrate; and drying the connected metal element and second element at a temperature of about 120° C.; and thereafter thing the connected metal element and second element at a temperature of about 1300° C., thereby solidifying the curable material.

13. The method of claim 12, further comprising:

providing the metal element in the form of a strip; and forming an array of openings onto the strip.

14. The method of claim 12, further comprising:

providing the metal element in the form of a strip; and forming a plurality of knurls onto the strip.

15. The method of claim 12, wherein the metal element has a mesh-like configuration.

16. The method of claim 12, wherein the metal element is a flattened, knurled wire.

17. The method of claim 12, wherein the metal element comprises platinum or a material coated with platinum.

18. The method of claim 12, further comprising:

disposing the conductive material so as to completely cover the metal element.

19. The method of claim 12, further comprising:

disposing the conductive material so as to cover the metal element only in area where the electrical and mechanical connection to the second element is to be made.

20. The method of claim 12, wherein disposing the conductive material comprises coating the metal element with a noble metal so as to completely cover the metal element with the noble metal.

21. The method of claim 12, wherein disposing the conductive material comprises coating the metal element with a noble metal only in the area where the electrical and mechanical connection to the second element is to be made.

22. The method of claim 12, further comprising the step of, subsequent to the drying and firing steps, coating a protective glass seal over the second surface of the metal element.

23. The method of claim 12 wherein the noble metal of the metal element is of the same composition as the noble metal of the pad, which is of the same composition as the noble metal of the conductive material are each the same noble metal.

* * * * *